US009090835B2

(12) United States Patent
Beech, Jr. et al.

(10) Patent No.: US 9,090,835 B2
(45) Date of Patent: Jul. 28, 2015

(54) PREHEATING FEEDS TO HYDROCARBON PYROLYSIS PRODUCTS HYDROPROCESSING

(75) Inventors: James H. Beech, Jr., Kingwood, TX (US); Teng Xu, Houston, TX (US); Keith G. Reed, Houston, TX (US); David T. Ferrughelli, Flemington, NJ (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 378 days.

(21) Appl. No.: 13/601,160

(22) Filed: Aug. 31, 2012

(65) Prior Publication Data

US 2014/0061095 A1 Mar. 6, 2014

(51) Int. Cl.

| | |
|---|---|
| ***C10L 1/00*** | (2006.01) |
| ***H01B 3/22*** | (2006.01) |
| ***C10G 69/06*** | (2006.01) |

(52) U.S. Cl.

CPC ..... *C10G 69/06* (2013.01)

(58) Field of Classification Search

CPC ..... C10G 69/06; C10G 49/18
USPC ..... 208/14, 108, 68
See application file for complete search history.

(56) References Cited

U.S. PATENT DOCUMENTS

| | | | | |
|---|---|---|---|---|
| 3,817,853 | A | 6/1974 | Folkins | |
| 4,173,529 | A | 11/1979 | Bauer | |
| 4,846,958 | A | 7/1989 | Feldman et al. | |
| 5,069,775 | A | 12/1991 | Grosboll | |
| 5,158,668 | A | 10/1992 | Chahar et al. | |
| 5,215,649 | A | 6/1993 | Grenoble et al. | |
| 5,370,787 | A | 12/1994 | Forbus, Jr. | |
| 5,871,634 | A | 2/1999 | Wiehe et al. | |
| 7,578,929 | B2 | 8/2009 | Stell et al. | |
| 8,083,931 | B2 | 12/2011 | McCoy et al. | |
| 2007/0007170 | A1 | 1/2007 | Strack et al. | |
| 2007/0090018 | A1 * | 4/2007 | Keusenkothen et al. | 208/106 |
| 2007/0163921 | A1 | 7/2007 | Keusenkothen et al. | |
| 2008/0015839 | A1 * | 1/2008 | Noureldin et al. | 703/18 |
| 2009/0057200 | A1 | 3/2009 | Leta et al. | |
| 2009/0272671 | A1 * | 11/2009 | Keusenkothen | 208/44 |
| 2010/0326887 | A1 | 12/2010 | McGehee et al. | |
| 2011/0005970 | A1 | 1/2011 | Ou et al. | |

FOREIGN PATENT DOCUMENTS

| | | |
|---|---|---|
| GB | 1159843 | 7/1969 |
| GB | 2 194 794 | 3/1988 |

OTHER PUBLICATIONS

Kemp, Ian C.. (2007). Pinch Analysis and Process Integration—A User Guide on Process Integration for the Efficient Use of Energy (2nd Edition). Elsevier. Online version available at: http://app.knovel.com/hotlink/toc/id:kpPAPIAUG1/pinch-analysis-process/pinch-analysis-process.*

* cited by examiner

*Primary Examiner* — Randy Boyer
*Assistant Examiner* — Juan Valencia

(57) ABSTRACT

The invention relates to upgraded pyrolysis products, hydroconversion processes for upgrading products obtained from hydrocarbon pyrolysis, equipment useful for such processes. In particular the invention provides methods for reducing coke fouling in such equipment.

19 Claims, 5 Drawing Sheets

PREHEATING FEEDS TO HYDROCARBON PYROLYSIS PRODUCTS HYDROPROCESSING

FIELD

The invention relates to upgraded pyrolysis products, processes for upgrading products obtained from hydrocarbon pyrolysis, equipment useful for such processes.

BACKGROUND

Pyrolysis processes such as steam cracking can be utilized for converting saturated hydrocarbon to higher-value products such as light olefin, e.g., ethylene and propylene. Besides these useful products, hydrocarbon pyrolysis can also produce a significant amount of relatively low-value products such as steam-cracker tar ("SCT").

SCT upgrading processes involving conventional catalytic hydroprocessing suffer from significant catalyst deactivation. The process can be operated at a temperature in the range of from 250° C. to 380° C., at a pressure in the range of 5400 kPa to 20,500 kPa, using catalysts containing one or more of Co, Ni, or Mo; but significant catalyst coking is observed. Although catalyst coking can be lessened by operating the process at an elevated hydrogen partial pressure, diminished space velocity, and a temperature in the range of 200° C. to 350° C.; SCT hydroprocessing under these conditions is undesirable because increasing hydrogen partial pressure worsens process economics, as a result of increased hydrogen and equipment costs, and because the elevated hydrogen partial pressure, diminished space velocity, and reduced temperature range favor undesired hydrogenation reactions.

SUMMARY

In one embodiment the invention relates to a hydrocarbon conversion process, comprising:

(a) providing a first mixture comprising ≥10.0 wt. % hydrocarbon based on the weight of the first mixture;

(b) pyrolysing the first mixture to produce a second mixture comprising ≥1.0 wt. % of $C_2$ unsaturates and ≥1.0 wt. % tar, the weight percents being based on the weight of the second mixture;

(c) separating a tar stream from the second mixture, wherein the tar stream contains ≥90 wt. % of the second mixture's molecules having an atmospheric boiling point of ≥290° C.;

(d) providing a utility fluid, the utility fluid comprising ≥1.0 wt. % aromatics based on the weight of the utility fluid;

(e) providing a hydrogen stream comprising molecular hydrogen;

(f) heating the tar stream by one or more of (i) exposing the tar stream to a temperature in the range of 200.0° C. to 400.0° C., (ii) exposing the utility fluid to a temperature ≥400.0° C. and then combining the tar stream with the heated utility fluid, and/or (iii) exposing the hydrogen stream to a temperature ≥400.0° C. and then combining the tar stream with the heated hydrogen stream;

(g) hydroprocessing in the hydroprocessing zone at least a portion of the heated tar stream in the presence of (i) the hydrogen stream and/or heated hydrogen stream and (ii) the utility fluid and/or the heated utility fluid under catalytic hydroprocessing conditions at a utility fluid:tar stream weight ratio in the range of 0.05 to 3.0 to produce a hydroprocessed product, wherein the utility fluid comprises the hydroprocessed product in an amount ≥10.0 wt. % based on the weight of the utility fluid.

In another embodiment the invention relates to a hydrocarbon conversion process, comprising:

(a) providing a first mixture comprising ≥50.0 wt. % hydrocarbon based on the weight of the first mixture;

(b) pyrolysing the first mixture in the presence of steam to produce a second mixture comprising ≥1.0 wt. % of $C_2$ unsaturates and ≥1.0 wt. % tar, the weight percents being based on the weight of the second mixture;

(c) separating a tar stream from the second mixture wherein the tar stream contains ≥90 wt. % of the second mixture's molecules having an atmospheric boiling point of ≥290° C.;

(d) providing a utility fluid, the utility fluid comprising ≥1.0 wt. % aromatics based on the weight of the utility fluid;

(e) providing a hydrogen stream comprising molecular hydrogen;

(f) heating the tar stream to a temperature $T_1$ in the range of 200.0° C. to 400.0° C. by one or more of (i) conducting the tar stream through at least one heater, (ii) conducting the tar stream through first channels of at least one heat exchanger and conducting a heat transfer fluid through second channels of the heat exchanger to abstract heat from the heat transfer fluid to the tar stream, or (iii) heating the utility fluid to a temperature ≥425.0° C. and combining the tar stream with the heated utility fluid;

(g) hydroprocessing at least a portion of the tar stream in a hydroprocessing zone in the presence of the hydrogen stream and the utility fluid under catalytic hydroprocessing conditions, the hydroprocessing conditions including a temperature in the range of from 300° C. to 500° C., a pressure in the range of 15 bar (absolute) to 135 bar (absolute), and a utility fluid:tar stream weight ratio in the range of 0.05 to 3.0, wherein (i) the utility fluid comprises the hydroprocessed product in an amount ≥50.0 wt. % based on the weight of the utility fluid and (ii) the heat transfer fluid comprises the hydroprocessed product in an amount ≥50.0 wt. % based on the weight of the heat transfer fluid.

BRIEF DESCRIPTION OF THE FIGURES

FIG. 2 illustrates a hydroprocessing reactor section using a lower temperature first reactor stage to minimize reactor preheat train coke fouling risk.

FIG. 3 illustrates hydroprocessor reactor section with tar feed bypassing the reactor feed/effluent heat exchanger and feed trim heater to minimize coking fouling risk.

FIG. 4 illustrates a hydroprocessor reactor section with reactor top catalyst bed heating to minimize coke fouling risk.

DETAILED DESCRIPTION

SCT is generally obtained as a product of hydrocarbon pyrolysis. The pyrolysis process can include, e.g., thermal pyrolysis, such as thermal pyrolysis processes utilizing water. One such pyrolysis process, steam cracking, is described in more detail below. The invention is not limited to steam cracking, and describing certain embodiments in terms of steam cracking is not meant to foreclose other pyrolysis processes within the broader scope of the invention.

The invention is based in part on the discovery that catalyst coking can be lessened by hydroprocessing the SCT in the presence of a utility fluid, the utility fluid comprising a significant amount of aromatics, e.g., single or multi ring aromatics. It is desired to heat the mixture of the SCT and utility fluid to the desired hydroprocessing temperature while avoiding coking of the preheating equipment while doing so.

Unlike conventional SCT hydroprocessing, the process can be operated at temperatures and pressures that favor the desired hydrocracking reaction over aromatics hydrogenation. The term "SCT" means (a) a mixture of hydrocarbons having one or more aromatic core and optionally (b) non-aromatic and/or non-hydrocarbon molecules, the mixture being derived from hydrocarbon pyrolysis and having a boiling range ≥about 550° F. (290° C.), e.g., ≥90.0 wt. % of the SCT molecules have an atmospheric boiling point ≥550° F. (290° C.). SCT can comprise, e.g., ≥50.0 wt. %, e.g., ≥75.0 wt. %, such as ≥90.0 wt. %, based on the weight of the SCT, of hydrocarbon molecules (including mixtures and aggregates thereof) having (i) one or more aromatic cores and (ii) a molecular weight ≥about $C_{15}$.

Hydroprocessing SCT improves the tar's applicability as a fuel oil by improving its compatibility with other fuel oils by lowering its viscosity, lowering its boiling point distribution, increasing its hydrogen content, and converting asphaltenes and asphaltene precursors thereby improving the thermal stability of the tar. The resulting fuel oil product can be, e.g., a fungible product for global commerce of significantly higher value than untreated tar.

Figure 1:
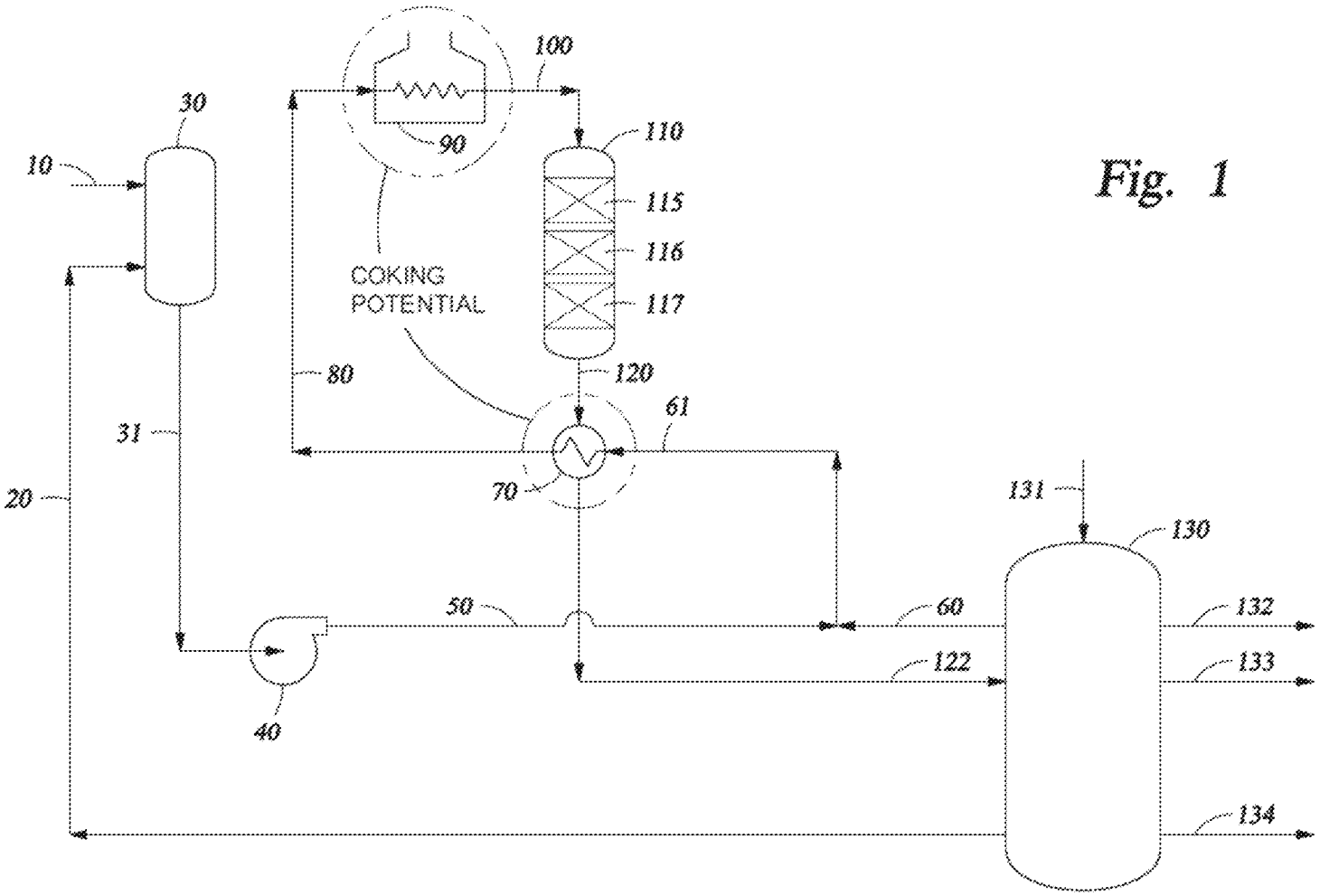
FIG. 1 schematically illustrates a process configuration for a hydroprocessing reactor section that uses a utility fluid to assist hydroprocessing of SCT. Areas of high coking potential are noted.

FIG. 1 schematically illustrates a hydroprocessing reactor section for hydroprocessing SCT. As shown in FIG. 1, an SCT stream 10 is combined with a utility fluid 20 in feed drum 30, is pumped by pump 40 through conduit 50, and then mixed with a hydrogen-containing stream 60. This mixture 61 is then pre-heated in heat exchanger 70 against the reactor effluent 120 followed by additional preheating to reactor inlet temperature in a process trim heater 90. The preheated mixture 100 is then conducted to a hydroprocessing reactor 110 having three catalyst beds 115, 116, 117 of substantially equal volume. Optionally, the same catalyst is utilized in each bed. The catalyst can be, e.g., conventional hydroprocessing catalyst, such as RT-621, available from Albermarle.

The hydroprocessor effluent stream is then conducted away from heat exchanger 70 via conduit 122 to one or more separation stages 130, for separating from the hydroprocessor effluent stream (i) a purge gas stream (comprising, e.g., excess or spent treat gas) which is conducted away via conduit 132, (ii) a hydroprocessed product (comprising, e.g., hydroprocessed SCT) which is conducted away via conduit 134, and (iii) a light gas stream (comprising, e.g., methane and hydrogen sulfide) which may be conducted away via conduit 133 for upgrading and/or use, e.g., as a fuel gas. Additional separations can be conducted in the separation stage, e.g., for separating from the hydroprocessed product a light fuel oil and/or a heavy fuel oil. Make-up treat gas (e.g., molecular hydrogen) can be conducted to separation stages 130 via conduit 131. Hydrogen-rich treat gas is conducted away from stage 130 via line 60, for recycle to the hydroprocessor 110. At least a portion of any $H_2S$ and $NH_3$ being removed in stage 130, before the treat gas enters line 60.

While the hydroprocessing of SCT improves the thermal stability, preheating the SCT to the desired reactor inlet temperature poses a risk of the thermally unstable SCT of forming foulants such as coke. Such coke will tend to foul the preheat equipment, the inlet to the reactor, and the upper portions of the catalyst bed.

It is observed that using a quartz-filled reactor, e.g. no catalyst fouling can occur on heating the utility fluid/tar/hydrogen mixture. The quartz is inert, in order to simulate any equipment exposed to the heated mixture. The reactor is run at 400° C. and 425° C. and the pressure drop across the reactor is measured. Increasing pressure drop with time is an indication that coke fouling is taking place.

Conditions are as follows:

Reactor: ⅜ in OD tube, 18 in. (45.72 cm) long, 12 in. (30.48) cm heated

Feed Composition: SCT Tar 60 wt. %; 40 wt. % trimethyl benzene utility fluid

Outlet Pressure: 1000 psi (68.9 bar)

Liquid Flow: 0.05 cc/min (3 ml/hr)

$H_2$Flow: 26.7 sccm (3000 scfb feed)

Figure 5:
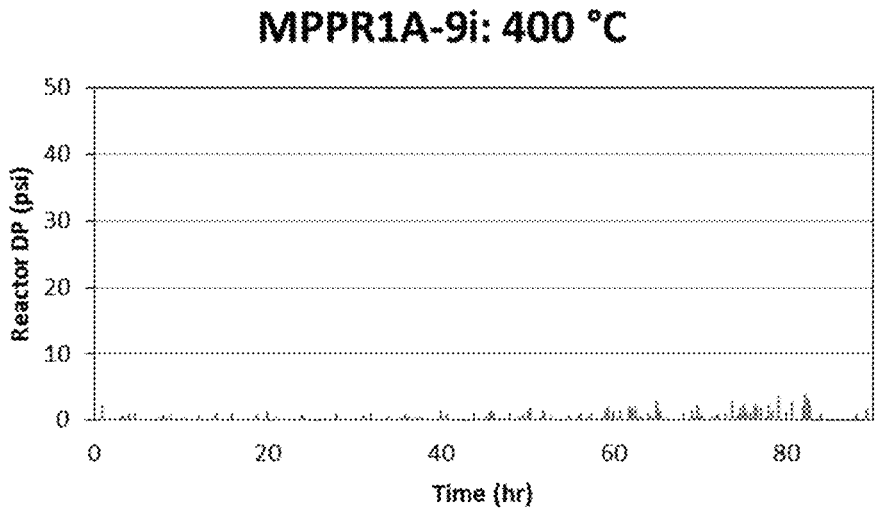
FIG. 5 shows two graphs of pressure drop across a reactor versus time at two different temperature levels.
Figure 5:
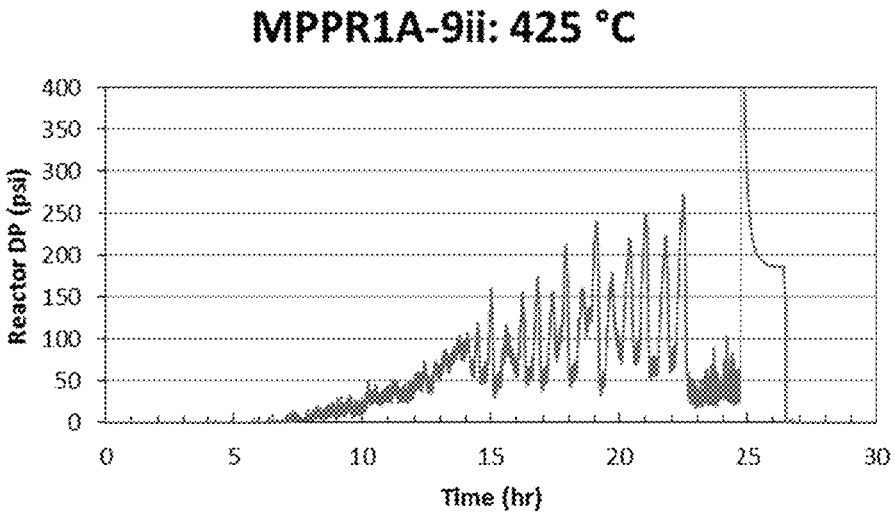

FIG. 5 presents the result by plotting the observed pressure drop across the reactor versus time on-stream at each temperature. Note that both the pressure drop and the time scale in the two plots are different. At 400° C. under these conditions, the pressure drop is almost negligible after over 80 hours on-stream. However, at 425° C., a rapid increase in pressure drop occurs after only 5 or 6 hours on-stream, resulting in reactor shut-down before 27 hours on-stream. The oscillation of pressure drop observed in the 425° C. plot is indicative of the coke fouling and plugging the flow of feed and hydrogen.

Such coke fouling will limit the length of time that the conversion process can be continuously operated. Once critical equipment becomes fouled with coke the conversion process will need to be interrupted to remove the coke. In order to be feasible for commercial operations the conversion process should be capable of operating continuously without significant fouling of the hydroprocessing equipment, or excessive coking of the hydroprocessing catalyst for at least 1 day ($8.6\times10^4$ seconds), preferably at least 1 week ($6.0\times10^5$ seconds), more preferably at least 1 month ($2.6\times10^6$ seconds), or most preferably at least 1 year ($3.2\times10^7$ seconds).

For example, for commercial operation pressure drops across the hydroprocessing reactor or other equipment should not exceed about 3.0, 4.0 or 5.0 times the initial (SOR) pressure drop at design flow rates.

For commercial operation it is desirable to have a safety margin below the temperature at which serious fouling is expected to occur. Further metal temperatures in heaters or heat exchangers will be higher than the bulk fluid temperature, which can lead to coke fouling of the hotter metal surfaces. Accordingly, the desirable maximum fluid bulk temperature of the tar is set significantly below the 425° C. temperature where excessive fouling is observed, e.g., in the range of 200.0° C. to 400.0° C., such as 300.0° C. to 400.0° C. Experience in steam cracking indicates that maintaining tar at bulk temperatures below 300° C. minimizes the risk of coke fouling of equipment. The various embodiments of the invention are illustrated maintaining the SCT or the SCT mixed with utility fluid and/or hydrogen below 300° C. One skilled in the art will appreciate that a temperature that is higher or lower than 300° C. for a particular situation can be selected without undue experimentation.

Specifically, in the example depicted in FIG. 1, it has been identified that under certain conditions the feed side of the reactor feed/effluent heat exchanger 70 and the reactor inlet feed trim heater 90 are at risk of fouling with coke if SCT, optionally in combination with utility fluid and/or molecular hydrogen, is preheated in this equipment at temperatures exceeding about 572° F. (300° C.). Thus, in certain embodiments the tar stream 10 enters the hydroprocessor at between 200° F.-572° F. (90° C.-300° C.) and is then heated to a hydroprocessor reactor inlet temperature of 700° F.-800° F. (370° C.-425° C.). FIG. 1 shows the hydroprocessing configuration and the location of equipment having the potential for coking by the tar stream (or tar combined with utility fluid and/or molecular hydrogen) before it is hydrotreated. In certain embodiments, the utility fluid comprises, e.g., a recycle hydroprocessed product of the conversion process, or a similar material. The utility fluid is thermally-stable at typical reactor preheat temperatures of 700° F.-800° F. (370° C.-425° C.) and unlike a fresh (untreated) tar stream, not prone to coking in the preheat equipment. The location of equipment in FIG. 1 highlighted with the dashed circle is at risk of coke fouling by the tar component in the feed when heated past about 572° F. (300° C.).

Certain embodiments of invention are based in part on the development of methods for preheating an untreated tar stream (such as SCT) to a hydroprocessing reactor's inlet temperature that lessen or even eliminate fouling of the preheat equipment (or mitigate the formation of catalyst coke) to allow continuous reactor operation. Other embodiments of the invention are based on the development of tar hydroprocessing processes that utilize a high-activity catalyst. In these embodiments, the need to pre-heat the tar upstream of hydroprocessing is lessened or eliminated because the hydroprocessing catalyst is sufficiently active at lower temperatures. These methods may be utilized singly or in combination. Use of the methods to be further described below, will permit the conversion process to operate continuously for at least 1 day ($8.6\times10^4$ seconds), preferably at least 1 week ($6.0\times10^5$ seconds), more preferably at least 1 month ($2.6\times10^6$ seconds), or most preferably at least 1 year ($3.2\times10^7$ seconds).

Characteristics of SCT

It has been observed that SCT comprises a significant amount of Tar Heavies ("TH"). For the purpose of this description and appended claims, the term "Tar Heavies" means a product of hydrocarbon pyrolysis, the TH has an atmospheric boiling point ≥565° C. and comprising ≥5.0 wt. % of molecules having a plurality of aromatic cores based on the weight of the product. The TH are typically solid at 25.0° C. and generally include the fraction of SCT that is not soluble in a 5:1 (vol.:vol.) ratio of n-pentane:SCT at 25.0° C. ("conventional pentane extraction"). The TH can include high-molecular weight molecules (e.g., MW≥600) such as asphaltenes and other high-molecular weight hydrocarbon. The term "asphaltene or asphaltenes" is defined as heptane insolubles, and is measured following ASTM D3279. For example, the TH can comprise ≥10.0 wt. % of high molecular-weight molecules having aromatic cores that are linked together by one or more of (i) relatively low molecular-weight alkanes and/or alkenes, e.g., $C_1$ to $C_3$ alkanes and/or alkenes, (ii) $C_5$ and/or $C_6$ cycloparaffinic rings, or (iii) thiophenic rings. Generally, ≥60.0 wt. % of the TH's carbon atoms are included in one or more aromatic cores based on the weight of the TH's carbon atoms, e.g., in the range of 68.0 wt. % to 78.0 wt. %. While not wishing to be bound by any theory or model, it is also believed that the TH form aggregates having a relatively planar morphology, as a result of Van der Waals attraction between the TH molecules. The large size of the TH aggregates, which can be in the range of, e.g., ten nanometers to several hundred nanometers ("nm") in their largest dimension, leads to low aggregate mobility and diffusivity under catalytic hydroprocessing conditions. In other words, conventional TH conversion suffers from severe mass-transport limitations, which result in a high selectivity for TH conversion to coke. It has been found that combining SCT with the utility fluid breaks down the aggregates into individual molecules of, e.g., ≤5.0 nm in their largest dimension and a molecular weight in the range of about 200 grams per mole to 2500 grams per mole. This results in greater mobility and diffusivity of the SCT's TH, leading to shorter catalyst-contact time and less conversion to coke under hydroprocessing condition. As a result, SCT conversion can be run at lower pressures, e.g., 500 psig to 1500 psig (34.5 to 103.4 bar gauge), leading to a significant reduction in cost and complexity over higher-pressure hydroprocessing. The invention is also advantageous in that the SCT is not over-cracked, so that the amount of light hydrocarbons produced, e.g., $C_4$ or lighter, is less than 5 wt. %, which further reduces the amount of hydrogen consumed in the hydroprocessing step.

SCT starting material differs from other relatively high-molecular weight hydrocarbon mixtures, such as crude oil residue ("resid") including both atmospheric and vacuum resids and other streams commonly encountered, e.g., in petroleum and petrochemical processing. The SCT's aromatic carbon content as measured by $^{13}C$ NMR is substantially greater than that of resid. For example, the amount of aromatic carbon in SCT typically is greater than 70 wt. % while the amount of aromatic carbon in resid is generally less than 40 wt. %. A significant fraction of SCT asphaltenes have an atmospheric boiling point that is less than 565° C., for example, only 32.5 wt. % of asphaltenes in SCT 1 have an atmospheric boiling point that is greater than 565° C. That is not the case with vacuum resid. Even though solvent extraction is an imperfect process, results indicate that asphaltenes in vacuum resid are mostly heavy molecules having atmospheric boiling point that is greater than 565° C. When subjected to heptane solvent extraction under substantially the same conditions as those used for vacuum resid, the asphaltenes obtained from SCT contains a much greater percentage (on a wt. basis) of molecules having an atmospheric boiling point <565° C. than is the case for vacuum resid. SCT also differs from resid in the relative amount of metals and nitrogen-containing compounds present. In SCT, the total amount of metals is ≤1000.0 ppmw (parts per million, weight) based on the weight of the SCT, e.g., ≤100.0 ppmw, such as ≤10.0 ppmw. The total amount of nitrogen present in SCT is generally less than the amount of nitrogen present in a crude oil vacuum resid.

Selected properties of two representative SCT samples and three representative resid samples are set out in the following table.

TABLE 1

| | SCT 1 | SCT 2 | RESID 1 | RESID 2 | RESID 3 |
|---|---|---|---|---|---|
| CARBON (wt. %) | 89.9 | 91.3 | 86.1 | 83.33 | 82.8 |
| HYDROGEN (wt. %) | 7.16 | 6.78 | 10.7 | 9.95 | 9.94 |
| NITROGEN (wt. %) | 0.16 | 0.24 | 0.48 | 0.42 | 0.4 |

TABLE 1-continued

| | SCT 1 | SCT 2 | RESID 1 | RESID 2 | RESID 3 |
|---|---|---|---|---|---|
| OXYGEN (wt. %) | 0.69 | N.M. | 0.53 | 0.87 | |
| SULFUR (wt. %) | 2.18 | 0.38 | 2.15 | 5.84 | 6.1 |
| Kinematic Viscosity at 50° C. (cSt) | 988 | 7992 | >1,000 | >1,000 | >1,000 |
| Weight % having an atmospheric boiling point ≥565° C. | 16.5 | 20.2 | | | |
| Asphaltenes | 22.6 | 31.9 | 91 | 85.5 | 80 |
| NICKEL wppm | 0.7 | N.M.* | 52.5 | 48.5 | 60.1 |
| VANADIUM wppm | 0.22. | N.M. | 80.9 | 168 | 149 |
| IRON wppm | 4.23 | N.M. | 54.4 | 11 | 4 |
| Aromatic Carbon (wt. %) | 71.9 | 75.6 | 27.78 | 32.32 | 32.65 |
| Aliphatic Carbon (wt. %) | 28.1 | 24.4 | 72.22 | 67.68 | 67.35 |
| Methyls (wt. %) | 11 | 7.5 | 9.77 | 13.35 | 11.73 |
| % C in long chains (wt. %) | 0.7 | 0.63 | 11.3 | 15.28 | 10.17 |
| Aromatic H (wt. %) | 38.1 | 43.5 | N.M. | N.M. | 6.81 |
| % Sat H (wt. %) | 60.8 | 55.1 | N.M. | N.M. | 93.19 |
| Olefins (wt. %) | 1.1 | 1.4 | N.M. | N.M. | 0 |

*N.M. = Not Measured

The SCT's aromatic carbon content is substantially greater than that of resid. The aliphatic carbon and % carbon in long chains is substantially lower in SCT compared to resid. Although the SCT's total carbon is only slightly higher and the oxygen content (wt. basis) is similar to that of resid, the SCT's metals, hydrogen, and nitrogen, content (wt. basis) range is considerably lower. The SCT's kinematic viscosity (cSt) at 50° C. is generally ≥1000, or ≥100 even though the relative amount of SCT having an atmospheric boiling point ≥565° C. is much less than is the case for resid.

SCT is generally obtained as a product of hydrocarbon pyrolysis. The pyrolysis process can include, e.g., thermal pyrolysis, such as thermal pyrolysis processes utilizing water. One such pyrolysis process, steam cracking, is described in more detail below. The invention is not limited to steam cracking, and this description is not meant to foreclose the use of other pyrolysis processes within the broader scope of the invention.

Obtaining SCT by Pyrolysis

Conventional steam cracking utilizes a pyrolysis furnace which has two main sections: a convection section and a radiant section. The feedstock (first mixture) typically enters the convection section of the furnace where the first mixture's hydrocarbon component is heated and vaporized by indirect contact with hot flue gas from the radiant section and by direct contact with the first mixture's steam component. The steam-vaporized hydrocarbon mixture is then introduced into the radiant section where the bulk of the cracking takes place. A second mixture is conducted away from the pyrolysis furnace, the second mixture comprising products resulting from the pyrolysis of the first mixture and any unreacted components of the first mixture. At least one separation stage is generally located downstream of the pyrolysis furnace, the separation stage being utilized for separating from the second mixture one or more of light olefin, SCN, SCGO, SCT, water, unreacted hydrocarbon components of the first mixture, etc. The separation stage can comprise, e.g., a primary fractionator. Generally, a cooling stage, typically either direct quench or indirect heat exchange is located between the pyrolysis furnace and the separation stage.

In one or more embodiments, SCT is obtained as a product of pyrolysis conducted in one or more pyrolysis furnaces, e.g., one or more steam cracking furnaces. Besides SCT, such furnaces generally produce (i) vapor-phase products such as one or more of acetylene, ethylene, propylene, butenes, and (ii) liquid-phase products comprising, e.g., one or more of $C_{5+}$ molecules and mixtures thereof. The liquid-phase products are generally conducted together to a separation stage, e.g., a primary fractionator, for separations of one or more of (a) overheads comprising steam-cracked naphtha ("SCN", e.g., $C_5$-$C_{10}$ species) and steam cracked gas oil ("SCGO"), the SCGO comprising ≥90.0 wt. % based on the weight of the SCGO of molecules (e.g., $C_{10}$-$C_{17}$ species) having an atmospheric boiling point in the range of about 400° F. to 550° F. (200° C. to 290° C.), and (b) bottoms comprising ≥90.0 wt. % SCT, based on the weight of the bottoms, the SCT having a boiling range ≥about 550° F. (290° C.) and comprising molecules and mixtures thereof having a molecular weight ≥about $C_{15}$.

The feed to the pyrolysis furnace is a first mixture, the first mixture comprising ≥10.0 wt. % hydrocarbon based on the weight of the first mixture, e.g., ≥25.0 wt. %, ≥50.0 wt. %, such as ≥65.0 wt. %. Although the hydrocarbon can comprise, e.g., one or more of light hydrocarbons such as methane, ethane, propane, butane etc., it can be particularly advantageous to utilize the invention in connection with a first mixture comprising a significant amount of higher molecular weight hydrocarbons because the pyrolysis of these molecules generally results in more SCT than does the pyrolysis of lower molecular weight hydrocarbons. As an example, it can be advantageous for the total of the first mixtures fed to a multiplicity of pyrolysis furnaces to comprise ≥1.0 wt. % or ≥25.0 wt. % based on the weight of the first mixture of hydrocarbons that are in the liquid phase at ambient temperature and atmospheric pressure.

The first mixture can further comprise diluent, e.g., one or more of nitrogen, water, etc., e.g., ≥1.0 wt. % diluent based on the weight of the first mixture, such as ≥25.0 wt. %. When the pyrolysis is steam cracking, the first mixture can be produced by combining the hydrocarbon with a diluent comprising steam, e.g., at a ratio of 0.1 to 1.0 kg steam per kg hydrocarbon, or a ratio of 0.2 to 0.6 kg steam per kg hydrocarbon.

In one or more embodiments, the first mixture's hydrocarbon comprises ≥10.0 wt. %, e.g., ≥50.0 wt. %, such as ≥90.0 wt. % (based on the weight of the hydrocarbon component) of one or more of naphtha, gas oil, vacuum gas oil, waxy residues, atmospheric residues, residue admixtures, or crude oil; including those comprising ≥about 0.1 wt. % asphaltenes. Suitable crude oils include, e.g., high-sulfur virgin crude oils, such as those rich in polycyclic aromatics. Optionally, the first mixture's hydrocarbon comprises sulfur, e.g., ≥0.1 wt. % sulfur based on the weight of the first mixture's hydrocarbon component, e.g., ≥1.0 wt. %, such as in the range of about 1.0 wt. % to about 5.0 wt. %. Optionally, at least a portion of the first mixture's sulfur-containing molecules, e.g., ≥10.0 wt. % of the first mixture's sulfur-containing molecules, contain at least one aromatic ring ("aromatic sulfur"). When (i) the first mixture's hydrocarbon is a crude oil or crude oil fraction comprising ≥0.1 wt. % of aromatic sulfur and (ii) the pyrolysis is steam cracking, then the, SCT contains a significant amount of sulfur derived from the first mixture's aromatic sulfur. For example, the SCT sulfur content can be about 3 to 4 times higher in the SCT than in the first mixture's hydrocarbon component, on a weight basis.

In a particular embodiment, the first mixture's hydrocarbon comprises one or more crude oils and/or one or more crude oil fractions, such as those obtained from an atmospheric pipestill ("APS") and/or vacuum pipestill ("VPS"). The crude oil and/or fraction thereof is optionally desalted prior to being included in the first mixture. An example of a crude oil fraction utilized in the first mixture is produced by combining separating APS bottoms from a crude oil and followed by VPS treatment of the APS bottoms.

Optionally, the pyrolysis furnace has at least one vapor/liquid separation device (sometimes referred to as flash pot or flash drum) integrated therewith, for upgrading the first mixture. Such vapor/liquid separator devices are particularly suitable when the first mixture's hydrocarbon component comprises ≥about 0.1 wt. % asphaltenes based on the weight of the first mixture's hydrocarbon component, e.g., ≥about 5.0 wt. %. Conventional vapor/liquid separation devices can be utilized to do this, though the invention is not limited thereto. Examples of such conventional vapor/liquid separation devices include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; and 7,235,705, which are incorporated by reference herein in their entirety. Suitable vapor/liquid separation devices are also disclosed in U.S. Pat. Nos. 6,632,351 and 7,578,929, which are incorporated by reference herein in their entirety. Generally, when using a vapor/liquid separation device, the composition of the vapor phase leaving the device is substantially the same as the composition of the vapor phase entering the device, and likewise the composition of the liquid phase leaving the flash drum is substantially the same as the composition of the liquid phase entering the device, i.e., the separation in the vapor/liquid separation device consists essentially of a physical separation of the two phases entering the drum.

In embodiments using a vapor/liquid separation device integrated with the pyrolysis furnace, at least a portion of the first mixture's hydrocarbon component is provided to the inlet of a convection section of a pyrolysis unit, wherein hydrocarbon is heated so that at least a portion of the hydrocarbon is in the vapor phase. When a diluent (e.g., steam) is utilized, the first mixture's diluent component is optionally (but preferably) added in this section and mixed with the hydrocarbon component to produce the first mixture. The first mixture, at least a portion of which is in the vapor phase, is then flashed in at least one vapor/liquid separation device in order to separate and conduct away from the first mixture at least a portion of the first mixture's high molecular-weight molecules, such as asphaltenes. A bottoms fraction can be conducted away from the vapor-liquid separation device, the bottoms fraction comprising, e.g., ≥10.0% (on a wt. basis) of the first mixture's asphaltenes. When the pyrolysis is steam cracking and the first mixture's hydrocarbon component comprises one or more crude oil or fractions thereof, the steam cracking furnace can be integrated with a vapor/liquid separation device operating at a temperature in the range of from about 600° F. (315° C.) to about 950° F. (510° C.) and a pressure in the range of about 275 kPa to about 1400 kPa, e.g., a temperature in the range of from about 430° C. to about 480° C. and a pressure in the range of about 700 kPa to 760 kPa. The overheads from the vapor/liquid separation device can be subjected to further heating in the convection section, and are then introduced via crossover piping into the radiant section where the overheads are exposed to a temperature ≥760° C. at a pressure ≥0.5 bar (g) e.g., a temperature in the range of about 790° C. to about 850° C. and a pressure in the range of about 0.6 bar (g) to about 2.0 bar (g), to carry out the pyrolysis (e.g., cracking and/or reforming) of the first mixture's hydrocarbon component.

One of the advantages of having a vapor/liquid separation device downstream of the convection section inlet and upstream of the crossover piping to the radiant section is that it increases the range of hydrocarbon types available to be used directly, without pretreatment, as hydrocarbon components in the first mixture. For example, the first mixture's hydrocarbon component can comprise ≥50.0 wt. %, e.g., ≥75.0 wt. %, such as ≥90.0 wt. % (based on the weight of the first mixture's hydrocarbon component) of one or more crude oils, even high naphthenic acid-containing crude oils and fractions thereof. Feeds having a high naphthenic acid content are among those that produce a high quantity of tar and are especially suitable when at least one vapor/liquid separation device is integrated with the pyrolysis furnace. If desired, the first mixture's composition can vary over time, e.g., by utilizing a first mixture having a first hydrocarbon component during a first time period and then utilizing a first mixture having a second hydrocarbon component during a second time period, the first and second hydrocarbons being substantially different hydrocarbons or substantially different hydrocarbon mixtures. The first and second periods can be of substantially equal duration, but this is not required. Alternating first and second periods can be conducted in sequence continuously or semi-continuously (e.g., in "blocked" operation) if desired. This embodiment can be utilized for the sequential pyrolysis of incompatible first and second hydrocarbon components (i.e., where the first and second hydrocarbon components are mixtures that are not sufficiently compatible to be blended under ambient conditions). For example, a first hydrocarbon component comprising a virgin crude oil can be utilized to produce the first mixture during a first time period and steam cracked tar utilized to produce the first mixture during a second time period.

In other embodiments, the vapor/liquid separation device is not used. For example when the first mixture's hydrocarbon comprises crude oil and/or one or more fractions thereof, the pyrolysis conditions can be conventional steam cracking conditions. Suitable steam cracking conditions include, e.g., exposing the first mixture to a temperature (measured at the radiant outlet)≥400° C., e.g., in the range of 400° C. to 900° C., and a pressure ≥0.1 bar, for a cracking residence time period in the range of from about 0.01 second to 5.0 second. In one or more embodiments, the first mixture comprises hydrocarbon and diluent, wherein the first mixture's hydrocarbon comprises ≥50.0 wt. % based on the weight of the first mixture's hydrocarbon of one or more of waxy residues, atmospheric residues, naphtha, residue admixtures, or crude oil. The diluent comprises, e.g., ≥95.0 wt. % water based on the weight of the diluent. When the first mixture comprises 10.0 wt. % to 90.0 wt. % diluent based on the weight of the first mixture, the pyrolysis conditions generally include one or more of (i) a temperature in the range of 760° C. to 880° C.; (ii) a pressure in the range of from 1.0 to 5.0 bar (absolute), or (iii) a cracking residence time in the range of from 0.10 to 2.0 seconds.

A second mixture is conducted away from the pyrolysis furnace, the second mixture being derived from the first mixture by the pyrolysis. When the specified pyrolysis conditions are utilized, the second mixture generally comprises ≥1.0 wt. % of $C_2$ unsaturates and ≥0.1 wt. % of TH, the weight percents being based on the weight of the second mixture. Optionally, the second mixture comprises ≥5.0 wt. % of $C_2$ unsaturates and/or ≥0.5 wt. % of TH, such as ≥1.0 wt. % TH. Although the second mixture generally contains a mixture of the desired light olefins, SCN, SCGO, SCT, and unreacted components of the first mixture (e.g., water in the case of steam cracking, but also in some cases unreacted hydrocarbon), the relative amount of each of these generally depends on, e.g., the first mixture's composition, pyrolysis furnace configuration, process conditions during the pyrolysis, etc. The second mixture is generally conducted away for the pyrolysis section, e.g., for cooling and separation stages.

In one or more embodiments, the second mixture's TH comprise ≥10.0 wt. % of TH aggregates having an average size in the range of 10.0 nm to 300.0 nm in at least one dimension and an average number of carbon atoms ≥50, the weight percent being based on the weight of Tar Heavies in the second mixture. Generally, the aggregates comprise ≥50.0 wt. %, e.g., ≥80.0 wt. %, such as ≥90.0 wt. % of TH molecules having a C:H atomic ratio in the range of from 1.0 to 1.8, a molecular weight in the range of 250 to 5000, and a melting point in the range of 100° C. to 700° C.

Although it is not required, the invention is compatible with cooling the second mixture downstream of the pyrolysis furnace, e.g., the second mixture can be cooled using a system comprising transfer line heat exchangers. For example, the transfer line heat exchangers can cool the process stream to a temperature in the range of about 700° C. to 350° C., in order to efficiently generate super-high pressure steam which can be utilized by the process or conducted away. If desired, the second mixture can be subjected to direct quench at a point typically between the furnace outlet and the separation stage. The quench can be accomplished by contacting the second mixture with a liquid quench stream, in lieu of, or in addition to the treatment with transfer line exchangers. Where employed in conjunction with at least one transfer line exchanger, the quench liquid is preferably introduced at a point downstream of the transfer line exchanger(s). Suitable quench liquids include liquid quench oil, such as those obtained by a downstream quench oil knock-out drum, pyrolysis fuel oil and water, which can be obtained from conventional sources, e.g., condensed dilution steam.

A separation stage is generally utilized downstream of the pyrolysis furnace and downstream of the transfer line exchanger and/or quench point for separating from the second mixture one or more of light olefin, SCN, SCGO, SCT, or water. Conventional separation equipment can be utilized in the separation stage, e.g., one or more flash drums, fractionators, water-quench towers, indirect condensers, etc., such as those described in U.S. Pat. No. 8,083,931. In the separation stage, a third mixture which is a tar stream can be separated from the second mixture, with the third mixture tar stream comprising ≥10.0 wt. % of the second mixture's TH based on the weight of the second mixture's TH. When the pyrolysis is steam cracking, the tar stream generally comprises SCT, which is obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof.

In one or more embodiments, the tar stream comprises ≥50.0 wt. % of the second mixture's TH based on the weight of the second mixture's TH. For example, the tar stream can comprise ≥90.0 wt. % of the second mixture's TH based on the weight of the second mixture's TH. The tar stream can have, e.g., (i) a sulfur content in the range of 0.5 wt. to 7.0 wt. %, (ii) a TH content in the range of from 5.0 wt. % to 40.0 wt. %, the weight percents being based on the weight of the tar stream, (iii) a density at 15° C. in the range of 1.01 g/cm$^3$ to 1.15 g/cm$^3$, e.g., in the range of 1.07 g/cm$^3$ to 1.15 g/cm$^3$, and (iv) a 50° C. viscosity in the range of 200 cSt to $1.0\times10^7$ cSt.

The tar stream can comprise TH aggregates. In one or more embodiments, the tar stream comprises ≥50.0 wt. % of the second mixture's TH aggregates based on the weight of the second mixture's TH aggregates. For example, the tar stream can comprise ≥90.0 wt. % of the second mixture's TH aggregates based on the weight of the second mixture's TH aggregates.

The tar stream is generally conducted away from the separation stage for hydroprocessing of the tar stream in the presence of a utility fluid. Examples of utility fluids useful in the invention will now be described in more detail. The invention is not limited to the use of these utility fluids, and this description is not meant to foreclose other utility fluids within the broader scope of the invention.

Utility Fluid

The utility fluid is utilized in hydroprocessing the tar stream, e.g., for effectively increasing run-length during hydroprocessing and improving the properties of the hydroprocessed product. Effective utility fluids comprise aromatics, i.e., comprise molecules having at least one aromatic core. In one or more embodiments the utility fluid comprises ≥40.0 wt. % aromatic carbon such as ≥60.0 wt. % aromatic carbon as measured by NMR. In one or more embodiments the utility fluid comprises a portion of the liquid phase of the hydroprocessed product, effectively being recycled back to the hydroprocessor. The remainder of the liquid phase of the hydroprocessed product may be conducted away from the process and optionally used as a low sulfur fuel oil blend component. The hydroprocessed product may optionally pass through one or more separation stages. Non-limiting examples of the separation stages may include: flash drums, distillation columns, evaporators, strippers, steam strippers, vacuum flashes, or vacuum distillation columns. These separation stages allow one skilled in the art to adjust the properties of the liquid phase to be used as the utility fluid. The liquid phase of the hydroprocessed product may comprise ≥90.0 wt. % of the hydroprocessed product's molecules having at least four carbon atoms based on the weight of the hydroprocessed product. In other embodiments, the liquid phase comprises ≥90.0 wt. % of the hydroprocessed product's molecules based on the weight of the hydroprocessed product having an atmospheric boiling point ≥65.0° C., ≥150.0° C., ≥260.0° C.

In another embodiment, the total liquid phase of the hydroprocessed product is separated into a light liquid and a heavy liquid where the heavy liquid comprises 90 wt. % of the molecules with an atmospheric boiling point of ≥300° C. that were present in the liquid phase. The utility fluid comprises a portion of the light liquid obtained from this separation. Optionally, in other embodiments, the utility fluid that comprises hydroprocessed product can be augmented or replaced by supplemental utility fluids such as described below.

In other embodiments the utility fluid comprises aromatics (i.e., comprises molecules having at least one aromatic core) and has an ASTM D86 10% distillation point ≥60° C. and a 90% distillation point ≤350° C. Optionally, the utility fluid (which can be a solvent or mixture of solvents) has an ASTM D86 10% distillation point ≥120° C., e.g., ≥140° C., such as ≥150° C. and/or an ASTM D86 90% distillation point ≤300° C.

In one or more embodiments, the utility fluid (i) has a critical temperature in the range of 285° C. to 400° C. and (ii) comprises ≥80.0 wt. % of 1-ring aromatics and/or 2-ring aromatics, including alkyl-functionalized derivatives thereof, based on the weight of the utility fluid. For example, the utility fluid can comprise, e.g., ≥90.0 wt. % of a single-ring aromatic, including those having one or more hydrocarbon substituents, such as from 1 to 3 or 1 to 2 hydrocarbon substituents. Such substituents can be any hydrocarbon group that is consistent with the overall utility fluid distillation characteristics. Examples of such hydrocarbon groups include, but are not limited to, those selected from the group consisting of $C_1$-$C_6$ alkyl, wherein the hydrocarbon groups can be branched or linear and the hydrocarbon groups can be the same or different. Optionally, the utility fluid comprises ≥90.0 wt. % based on the weight of the utility fluid of one or more of benzene, ethylbenzene, trimethylbenzene, xylenes, toluene, naphthalenes, alkylnaphthalenes (e.g., methylnaphtalenes), tetralins, or alkyltetralins (e.g., methyltetralins). It is generally desirable for the utility fluid to be substantially free of molecules having alkenyl functionality, particularly in embodiments utilizing a hydroprocessing catalyst having a tendency for coke formation in the presence of such molecules. In an embodiment, the utility fluid comprises ≤10.0 wt. % of ring compounds with $C_1$-$C_6$ sidechains having alkenyl functionality, based on the weight of the utility fluid.

In certain embodiments, the utility fluid comprises SCN and/or SCGO, e.g., SCN and/or SCGO separated from the second mixture in a primary fractionator downstream of a pyrolysis furnace operating under steam cracking conditions. The SCN or SCGO may be hydrotreated in different conventional hydrotreaters (e.g. not hydrotreated with the tar). The utility fluid can comprise, e.g., ≥50.0 wt. % of the separated gas oil, based on the weight of the utility fluid. In certain embodiments, at least a portion of the utility fluid is obtained from the hydroprocessed product, e.g., by separating and re-cycling a portion of the hydroprocessed product having an atmospheric boiling point ≤300° C.

Generally, the utility fluid contains sufficient amount of molecules having one or more aromatic cores to effectively increase run length during hydroprocessing of the tar stream. For example, the utility fluid can comprise ≥50.0 wt. % of molecules having at least one aromatic core, e.g., ≥60.0 wt. %, such as ≥70 wt. %, based on the total weight of the utility fluid. In an embodiment, the utility fluid comprises (i)≥60.0 wt. % of molecules having at least one aromatic core and (ii)≤1.0 wt. % of $C_1$-$C_6$ sidechains having alkenyl functionality, the weight percents being based on the weight of the utility fluid.

The utility fluid is utilized in hydroprocessing the tar stream, e.g., for effectively increasing run-length during hydroprocessing. The relative amounts of utility fluid and tar stream during hydroprocessing are generally in the range of from about 20.0 wt. % to about 95.0 wt. % of the tar stream and from about 5.0 wt. % to about 80.0 wt. % of the utility fluid, based on total weight of utility fluid plus tar stream. For example, the relative amounts of utility fluid and tar stream during hydroprocessing can be in the range of (i) about 20.0 wt. % to about 90.0 wt. % of the tar stream and about 10.0 wt. % to about 80.0 wt. % of the utility fluid, or (ii) from about 40.0 wt. % to about 90.0 wt. % of the tar stream and from about 10.0 wt. % to about 60.0 wt. % of the utility fluid. Optionally, the utility fluid:tar weight ratio in the hydroprocessor feed is in the range of 0.05:1.0 to 3.0:1.0. At least a portion of the utility fluid can be combined with at least a portion of the tar stream within the hydroprocessing vessel or hydroprocessing zone, but this is not required, and in one or more embodiments at least a portion of the utility fluid and at least a portion of the tar stream are supplied as separate streams and combined into one feed stream prior to entering (e.g., upstream of) the hydroprocessing vessel or hydroprocessing zone). In certain embodiments, the feed stream to the hydroprocessor comprises 40.0 wt. % to 90.0 wt. % of SCT and 10.0 wt. % to 60.0 wt. % of utility fluid, the weight percents being based on the weight of the feed stream.

Hydroprocessing

Hydroprocessing of the tar stream in the presence of the utility fluid can occur in one or more hydroprocessing stages, the stages comprising one or more hydroprocessing vessels or zones. Vessels and/or zones within the hydroprocessing stage in which catalytic hydroprocessing activity occurs generally include at least one hydroprocessing catalyst. The catalysts can be mixed or stacked, such as when the catalyst is in the form of one or more fixed beds in a vessel or hydroprocessing zone.

Conventional hydroprocessing catalyst can be utilized for hydroprocessing the tar stream in the presence of the utility fluid, such as those specified for use in resid and/or heavy oil hydroprocessing, but the invention is not limited thereto. Suitable hydroprocessing catalysts include those comprising (i) one or more bulk metals and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

In one or more embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst will contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Catalysts which further comprise inorganic oxides, e.g., as a binder and/or support, are within the scope of the invention. For example, the catalyst can comprise (i) ≥1.0 wt. % of one or more metals selected from Groups 6, 8, 9, and 10 of the Periodic Table and (ii) ≥1.0 wt. % of an inorganic oxide, the weight percents being based on the weight of the catalyst.

The invention encompasses incorporating into (or depositing on) a support one or catalytic metals e.g., one or more metals of Groups 5 to 10 and/or Group 15, to form the hydroprocessing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include, activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst is a supported catalyst, the support comprising at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain embodiments, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature ≥400° C. to form the hydroprocessing catalyst. Typically, such heat treating is conducted at temperatures ≤1200° C.

The catalyst can be in shaped forms, e.g., one or more of discs, pellets, extrudates, etc., though this is not required. Non-limiting examples of such shaped forms include those having a cylindrical symmetry with a diameter in the range of from about 0.79 mm to about 3.2 mm ($1/32^{nd}$ to $1/8^{th}$ inch), from about 1.3 mm to about 2.5 mm ($1/20^{th}$ to $1/10^{th}$ inch), or from about 1.3 mm to about 1.6 mm ($1/20^{th}$ to $1/16^{th}$ inch). Similarly-sized non-cylindrical shapes are within the scope of the invention, e.g., trilobe, quadralobe, etc. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are within the scope of the invention. When a porous catalyst is utilized, the catalyst can have a pore structure, pore size, pore volume, pore shape, pore surface area, etc., in ranges that are characteristic of conventional hydroprocessing catalysts, though the invention is not limited thereto. For example, the catalyst can have a median pore size that is effective for hydroprocessing SCT molecules, such catalysts having a median pore size in the range of from 30 Å to 1000 Å, or 50 Å to 500 Å, or 60 Å to 300 Å. Pore size can be determined according to ASTM Method D4284-07 Mercury Porosimetry.

In a particular embodiment, the hydroprocessing catalyst has a median pore diameter in a range of from 50 Å to 200 Å. Alternatively, the hydroprocessing catalyst has a median pore diameter in a range of from 90 Å to 180 Å, or 100 Å to 140 Å, or 110 Å to 130 Å. In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å. In yet another alternative, hydroprocessing catalysts having a larger median pore diameter are utilized, e.g., those having a median pore diameter in a range of from 180 Å to 500 Å, or 200 Å to 300 Å, or 230 Å to 250 Å.

Generally, the hydroprocessing catalyst has a pore size distribution that is not so great as to significantly degrade catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have, e.g., a pore volume ≥0.3 $cm^3/g$, such ≥0.7 $cm^3/g$, or ≥0.9

$cm^3/g$. In certain embodiments, pore volume can range, e.g., from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydroprocessing catalyst can have a surface area ≥60 $m^2/g$, or ≥100 $m^2/g$, or ≥120 $m^2/g$, or ≥170 $m^2/g$, or ≥220 $m^2/g$, or ≥270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Hydroprocessing the specified amounts of tar stream and utility fluid using the specified hydroprocessing catalyst leads to improved catalyst life, e.g., allowing the hydroprocessing stage to operate for at least 3 months ($7.8\times10^6$ seconds), or at least 6 months ($1.6\times10^7$ seconds), or at least 1 year ($3.2\times10^7$ seconds) without replacement of the catalyst in the hydroprocessing or contacting zone. Catalyst life is generally >10 times longer than would be the case if no utility fluid were utilized, e.g., ≥100 times longer, such as ≥1000 times longer.

The hydroprocessing is carried out in the presence of hydrogen, e.g., by (i) combining molecular hydrogen with the tar stream and/or utility fluid upstream of the hydroprocessing and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed product for re-use, generally after removing undesirable impurities, such as $H_2S$ and $NH_3$. The treat gas optionally contains ≥about 50 vol. % of molecular hydrogen, e.g., ≥about 75 vol. %, based on the total volume of treat gas conducted to the hydroprocessing stage.

Optionally, the amount of molecular hydrogen supplied to the hydroprocessing stage is in the range of from about 300 SCF/B (standard cubic feet per barrel) (53 S $m^3/m^3$) to 5000 SCF/B (890 S $m^3/m^3$), in which B refers to barrel of the tar stream. For example, the molecular hydrogen can be provided in a range of from 1000 SCF/B (178 S $m^3/m^3$) to 3000 SCF/B (534 S $m^3/m^3$). Hydroprocessing the tar stream in the presence of the specified utility fluid, molecular hydrogen, and a catalytically effective amount of the specified hydroprocessing catalyst under catalytic hydroprocessing conditions produces a hydroprocessed product including, e.g., upgraded SCT. An example of suitable catalytic hydroprocessing conditions will now be described in more detail. The invention is not limited to these conditions, and this description is not meant to foreclose other hydroprocessing conditions within the broader scope of the invention.

The hydroprocessing is generally carried out under hydroconversion conditions, e.g., under conditions for carrying out one or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing of the specified tar stream. The hydroprocessing reaction can be carried out in at least one vessel or zone that is located, e.g., within a hydroprocessing stage downstream of the pyrolysis stage and separation stage. The specified tar stream generally contacts the hydroprocessing catalyst in the vessel or zone, in the presence of the utility fluid and molecular hydrogen. Catalytic hydroprocessing conditions can include, e.g., exposing the combined diluent-tar stream to a temperature in the range from 50° C. to 500° C. or from 200° C. to 450° C. or from 220° C. to 430° C. or from 350° C. to 420° C. proximate to the molecular hydrogen and hydroprocessing catalyst. For example, a temperature in the range of from 300° C. to 500° C., or 350° C. to 430° C., or 360° C. to 420° C. can be utilized. Weight hourly space velocity (WHSV) of the combined utility fluid tar stream will generally range from 0.1 $h^{-1}$ to 30 $h^{-1}$, or 0.1 $h^{-1}$ to 25 $h^{-1}$, or 0.1 $h^{-1}$ to 4.0 $h^{-1}$. In some embodiments, LHSV is at least 0.1 $h^{-1}$, 5 $h^{-1}$, or at least 10 $h^{-1}$, or at least 15 $h^{-1}$. Molecular hydrogen partial pressure during the hydroprocessing is generally in the range of from 0.1 MPa to 8 MPa, or 1 MPa to 7 MPa, or 2 MPa to 6 MPa, or 3 MPa to 5 MPa. In some embodiments, the partial pressure of molecular hydrogen is ≤7 MPa, or ≤6 MPa, or ≤5 MPa, or ≤4 MPa, or ≤3 MPa, or ≤2.5 MPa, or ≤2 MPa. The hydroprocessing conditions can include, e.g., one or more of a temperature in the range of 300° C. to 500° C., a pressure in the range of 15 bar (absolute) to 135 bar, a space velocity in the range of 0.1 to 5.0 WHSV, and a molecular hydrogen consumption rate per volume of tar of about 53 standard cubic meters/cubic meter (S $m^3/m^3$) to about 445 S $m^3/m^3$ (300 SCF/B to 2500 SCF/B). In one or more embodiment, the hydroprocessing conditions include one or more of a temperature in the range of 380° C. to 430° C., a pressure in the range of 21 bar (absolute) to 81 bar (absolute), a space velocity in the range of 0.2 to 1.0, and a hydrogen consumption rate of about 71 S $m^3/m^3$ to about 267 S $m^3/m^3$ (400 SCF/B to 1500 SCF/B). When operated under these conditions using the specified catalyst, TH hydroconversion is generally ≥25.0% on a weight basis, e.g., ≥50.0%.

Fouling/Coking Mitigation of Preheat Equipment

The problem of coke fouling of preheat equipment can be reduced or eliminated, e.g., by certain embodiments of the invention that are now described in more detail with reference to FIGS. 2-4. It is understood that these methods may be utilized singly or in combination. The invention is not limited to these embodiments, and this description is not meant to foreclose other foulant-reduction methods within the broader scope of the invention.

Figure 2:
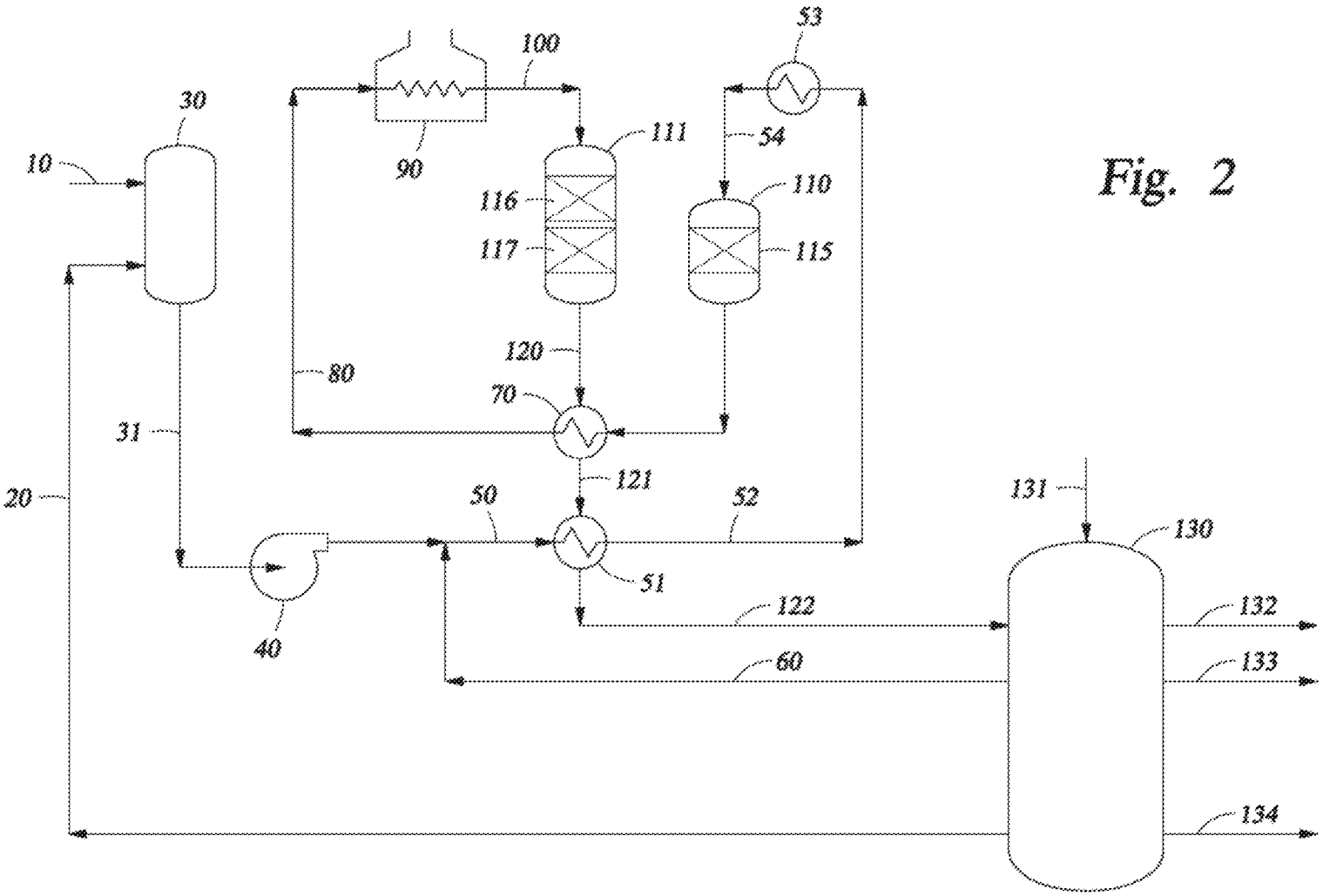
FIGS. 2-4 schematically illustrate example of process configurations that are within the scope of the invention. The invention is not limited to these embodiments, and this description is not meant to foreclose other embodiments within the broader scope of the invention.
Figure 3:
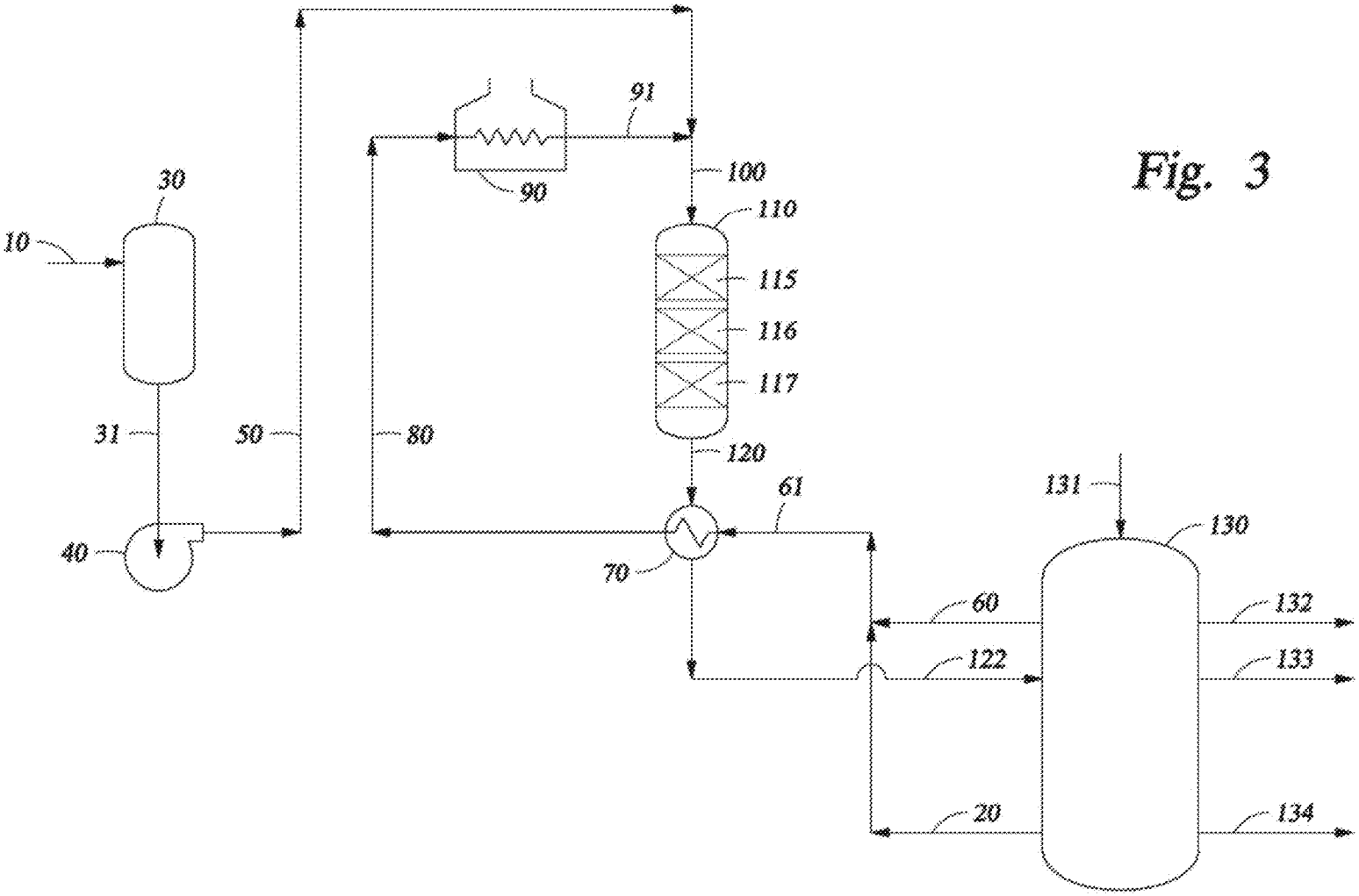
Figure 4:
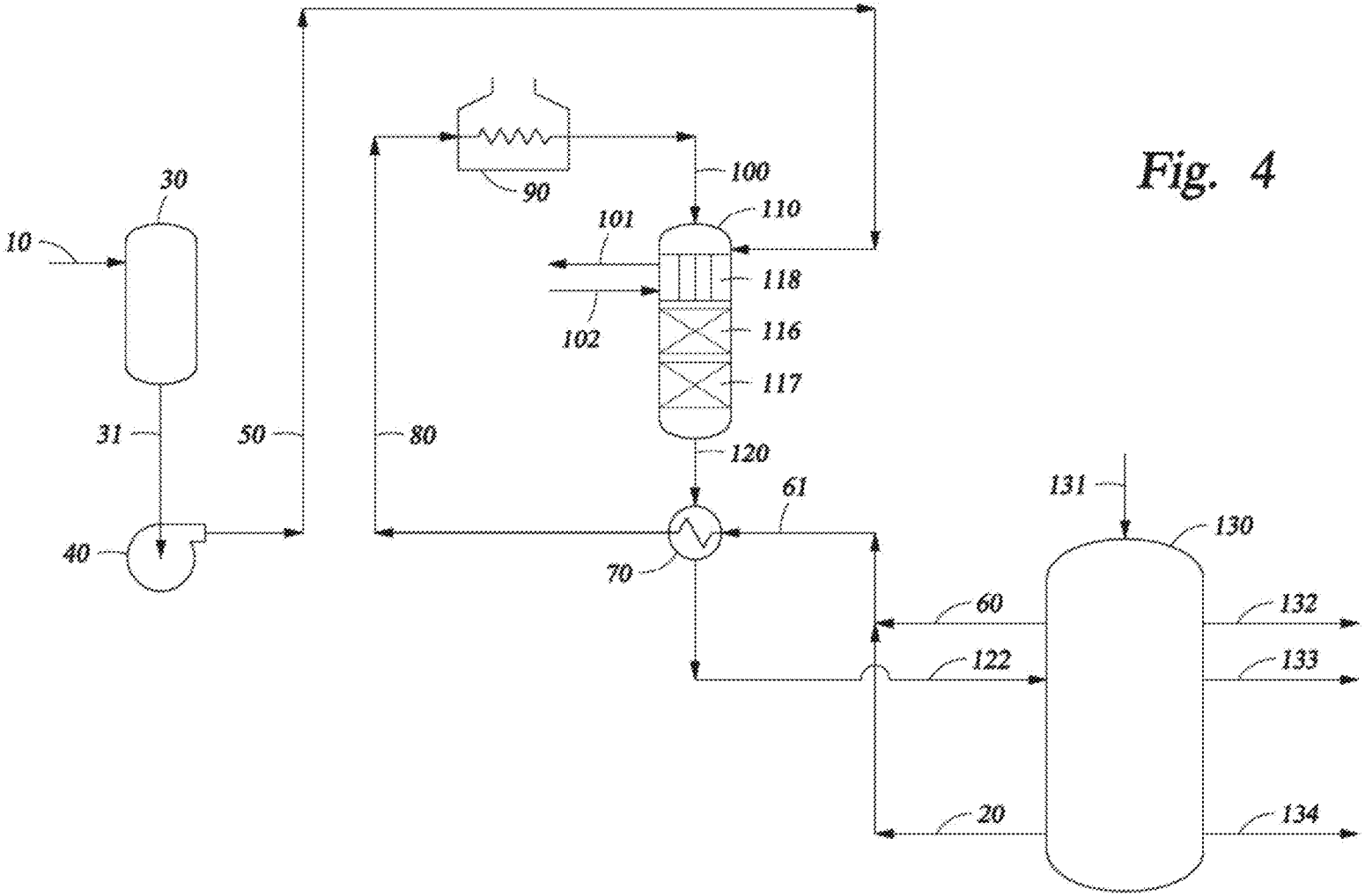

In FIGS. 2-4, apparatus performing substantially the same (or a similar) function as in FIG. 1 are identified by the same reference number.

FIG. 2 depicts an embodiment wherein a lower temperature first reactor stage is used to minimize reactor preheat train coke fouling risk. This embodiment employs additional heat sources: pre-heaters 51 and 53. Heat source 51 can be, e.g., a heat exchanger utilized to further pre-heat the hydroprocessor feed by abstracting heat from the hydroprocessor effluent conducted downstream of heat exchanger 70 via line 121. Heat source 53 can be, e.g., a second set of tubes in trim heater 90. This embodiment also employs a first lower temperature stage 110 hydroprocessing reactor where the first reactor stage feed 54 is only heated to between 500° F.-600° F. (260° C.-315° C.) and does not foul the reactor feed preheaters 51 and 53 at that temperature. Effectively, the first reactor stage (or zone) operates at a temperature of at least 100° C. less than the second hydroprocessor stage (or zone) 111. Optionally, the first reactor stage may operate at a temperature at least 50° C. or 25° C. less than the second stage. The effluent 55 from the first stage reactor 110 is expected to be thermally stable and optionally may then be further preheated without a risk of coke fouling.

The first hydroprocessing stage 110 hydrotreats the most reactive coke precursors (asphaltenes, cyclodienes, vinylaromatics, olefins, dienes, oxygenated species) so that the resulting first stage reactor effluent 55 can be further heated to second stage reactor inlet temperature in preheater 90 without coking. The feed side of the feed/effluent heat exchanger 70 will also be protected from coking by this configuration. This embodiment is further enabled by choosing a higher activity catalyst for catalyst bed 115 which allows the first stage reactor to operate at a lower temperature Lower reactor inlet temperature below which tar coking occurs is enabled by using a more active hydrotreating catalyst that may include, but not limited to:

a. Nebula 20 available from Albemarle b. Criterion DN3651, DN3551 c. Albermarle KF860

Increasing utility fluid/tar ratio in the reactor feed will reduce feed coking, up to a point. The process illustrated in FIG. 2 is compatible with a utility fluid/tar ratio of 40 wt. % utility fluid/60 wt. % tar. Increasing this ratio will tend to reduce coking as the utility fluid does not form coke, e.g., where the reactor feed has a utility fluid:tar weight ration ≥0.7, e.g., ≥1.0, such as ≥3.0.

FIG. 3 depicts an embodiment wherein the SCT feed bypasses the reactor feed/effluent heat exchanger and feed trim heater to avoid tar coking risk. In this embodiment the SCT 10 is not heated in either the reactor feed/effluent exchanger 70 or the reactor feed trim heater 90 but rather is brought to temperature near the reactor inlet or within the reactor feed distributor when it mixes with utility fluid and hydrogen 91 that has been sufficiently overheated in the reactor feed/effluent exchanger 70 and reactor feed trim heater 90. The hydrogen 60 and utility fluid 20 are mixed and conducted to the feed side of the reactor feed/effluent exchanger 70 and then to the reactor feed trim heater 90 and heated above the desired reactor inlet temperature. This hot mixture 91 is then mixed with the SCT 50 and the entire mixture 100 enters the reactor 110 now at the desired reactor inlet temperature. The risk of tar coke fouling in the reactor feed/effluent exchanger 70 and reactor feed trim heater 90 has been lessened or eliminated, as the SCT feed is not pre-heated. Optionally, in another embodiment not shown FIG. 3, only the utility fluid passes through the feed/effluent exchanger. The tar feed, the utility fluid, and recycle hydrogen can then be heated in the reactor feed trim heater.

The concept of this embodiment is not preheating the tar stream above the temperature at which coking becomes a problem. Rather, the preheat energy is provided by heating the utility fluid and hydrogen above the desired reactor inlet temperature and then mixing the tar stream with the hotter utility fluid and hydrogen at or in close proximity to the reactor inlet, where it will mix to the desired reactor inlet temperature and immediately contact catalyst and begin the hydroprocessing reactions.

In another embodiment the reactor feed/effluent heat exchanger and feed trim heater are spared. This option mitigates the effect of whatever tar coke fouling that does occurs. The sparing will allow online or offline decoking and more importantly allows continuous reactor operation. A drum downstream of the feed trim heater may be included to recover the spalled coke during the decoking operation. This concept may also be applied to any of the process configurations as an added mitigation against coking risk.

Utilizing a design of the feed trim heater to minimize coking by designing for higher mass fluxes than in normal heaters (up to 4394 kg/sec $m^2$ vs. typically 1465 kg/sec $m^2$), lower heat fluxes of less than 31,500 $W/m^2$, and maximum film temperatures of less than 910° F. (488° C.).

FIG. 4 depicts an embodiment wherein heat is applied to the reactor top catalyst bed to minimize the coke fouling risk. SCT is not preheated in either the reactor feed/effluent exchanger 70 or the reactor feed trim heater 90, but rather is brought to temperature gradually as the reactions proceed within the reactor 110 itself by supplying external heat 102 to at least the first catalyst bed 118. For example the first catalyst bed can be designed as a tubular reactor with catalyst in the tubes and a heat transfer fluid in the shell. In one embodiment the heat is supplied by a heat transfer fluid in streams 102 and 101 which heat the catalyst and feed simultaneously.

In other embodiments streams 102 and 101 can represent steam or a hot process stream or any other source of heat, e.g., external electric wall heaters. This methodology is observed to lessen or eliminate fouling in pilot plant studies. It is found that preheating the tar, utility fluid and hydrogen while in the presence of the catalyst results in many more successful, non-coking runs than preheating before contact with the catalyst. It should be appreciated that the design of the tubular reactor catalyst bed is within the scope of one skilled in the art of design. Similarly, a temperature control system can be designed by one skilled in the art of process control taking into account that heat is being added to an exothermic reaction zone.

The utility fluid and hydrogen may optionally be preheated in the reactor feed/effluent heat exchanger 70 and reactor feed trim heater 90 as required to be more energy efficient and reduce the heating requirements of the heat source in the hydroprocessor reactor. The SCT is not preheated in either the reactor feed/effluent heat exchanger 70 or the reactor feed trim heater 90. In another embodiment not shown in FIG. 4 the SCT may be preheated to a temperature low enough to avoid coking or fouling.

In embodiments that utilize hydroprocessed liquid product recycle as the utility fluid the recycle may de-gassed by taking the recycle from the bottom of a stabilizer distillation column. This liquid recycle can also be taken from the bottoms of a flash separator.

EXAMPLES

Following are examples of the embodiments depicted in FIGS. 2-4 calculated using PRO/II® process simulation software, available from Invensys Inc. PRO/II® process simulation software is a steady-state simulator enabling improved process design and operational analysis. It is designed to perform rigorous mass and energy balance calculations for a wide range of chemical processes. Characterization of reactor feed and product used in the PRO/II® simulations were based on boiling point curves (simulated distillation GC, ASTM D2887) and density from experimental data.

For all the examples, referring to FIGS. 1, 2, 3, and 4, the separation stages 130 represents conventional separation equipment for hydroprocessing comprising high temperature and low temperature separators, a stabilizer, acid gas removal, and associated equipment such as exchangers and compressors for recycle gas. Optionally, a light fuel and heavy fuel oil splitter is provided to produce two hydroprocessed products. In this option the light fuel oil is used as the utility fluid 20.

The hydroprocessor effluent stream 122 enters the separation stages 130. The aforementioned equipment in the separation stages separates this stream into products and by-products including the hydroprocessed product 134, a purge gas stream 132, and a light gas stream 133 which may be used as fuel gas. If the optional light fuel and heavy fuel oil splitter is provided then stream 134 represents two separate products, light fuel oil and heavy fuel oil. Make-up hydrogen enters the separation stages 130 as stream 131. Stream 60 is the recycle hydrogen rich gas. In all cases, $H_{25}$ and $NH_3$ are removed in the separation stages 130, before stream 60 is sent back to the hydroprocessor.

Comparative Example 1

In the comparative example depicted in FIG. 1 as indicated, the feed side of the reactor feed/effluent heat exchanger 70 and the reactor inlet feed trim heater 90 are at risk of fouling with coke. In all of the examples, unless otherwise indicated, the catalyst is assumed to be a conventional hydroprocessing catalyst, such as RT-621, available from Albermarle. The required hydroprocessor reactor inlet 100 for this catalyst is assumed to be 750° F. (400° C.) and 995 psig (67 bar).

Example 2

FIG. 2 depicts an embodiment wherein a lower temperature first reactor stage is used to minimize reactor preheat train coke fouling risk. This embodiment employs a first lower temperature stage 110 hydroprocessing reactor utilizing a more active catalyst such as Nebula 20 Criterion DN3651, DN3551 or Albermarle KF860 so that the first reactor stage feed 54 is only heated to 600° F. (375° C.). The first stage reactor effluent 55 reaches 611° F. (322° C.). However at this point the most reactive coke precursors (asphaltenes, cyclodienes, vinyl-aromatics, olefins, dienes, oxygenated species) have been hydrotreated. The first stage reactor effluent 55 is then heated to 742° F. (394° C.) in the feed preheat exchanger 70 and to the second stage reactor inlet temperature 750° F. (400° C.) is preheater 90. The second stage reactor 111 contains two beds 116, 117 of RT-621 catalyst.

Example 3

FIG. 3 depicts an embodiment wherein the SCT feed bypasses the reactor feed/effluent heat exchanger 70 and reactor feed trim heater 90. In this example the SCT feed stream 50 is at 534° F. (279° C.). The hydrogen 60 and utility fluid 20 are mixed and conducted to the feed side of the reactor feed/effluent exchanger 70 and heated to 780° F. (415° C.) against the 804° F. (429° C.) reactor effluent 120. Then the heated stream 80 is conducted to the reactor feed trim heater 90 and heated to 940° F. (504° C.). This 940° F. (504° C.) hot mixture 91 is then mixed with the 534° F. (279° C.) SCT 50 and the entire mixture 100, now at the desired reactor inlet temperature of 750° F. (400° C.), enters the reactor 110.

Example 4

FIG. 4 depicts an embodiment wherein heat is applied to the reactor top catalyst bed to minimize the coke fouling risk. SCT is not preheated in either the reactor feed/effluent exchanger 70 or the reactor feed trim heater 90, but rather is brought to the 750° F. (400° C.) reaction temperature gradually as the reactions proceed within the first catalyst zone 118 of the reactor 110. The hydrogen 60 and utility fluid 20 are mixed and conducted to the feed side of the reactor feed/effluent exchanger 70 and then to the reactor feed trim heater 90 and heated to 750° F. (400° C.). The mixture 100 then enters the reactor 110. The SCT feed stream 50 at 534° F. (279° C.) also enters the reactor 110. The first catalyst bed 118 bed is designed as a tubular reactor with RT-621 catalyst in the tubes and a heat transfer fluid in the shell. The mixture of heated hydrogen and utility fluid 100 mixes with the SCT feed stream and enters the tubes of 118 containing the catalyst and begins reacting. The heat transfer fluid stream 102 enters the shell side of 118 at 800° F.-850° F. (427° C.-454° C.) supplying heat to the reactor and leaves as stream 101 which then can be externally heated in another coil (not shown) in the trim preheat furnace 90. The mixture of SCT feed, utility fluid and hydrogen leaves the tubular reactor 118 at the desired reaction temperature 750° F. (400° C.) and enters the catalyst beds 116 and 117 containing RT-621 catalyst.

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A hydrocarbon conversion process, comprising:

(a) providing a first mixture comprising ≥10.0 wt. % hydrocarbon based on the weight of the first mixture;

(b) pyrolysing the first mixture to produce a second mixture comprising ≥1.0 wt. % of $C_2$ unsaturates and ≥1.0 wt. % tar, the weight percents being based on the weight of the second mixture;

(c) separating a tar stream from the second mixture, wherein the tar stream contains ≥90 wt. % of the second mixture's molecules having an atmospheric boiling point of ≥290° C.;

(d) providing a utility fluid, the utility fluid comprising ≥1.0 wt. % aromatics based on the weight of the utility fluid;

(e) providing a hydrogen stream comprising molecular hydrogen;

(f) heating the tar stream by one or more of (i) exposing the tar stream to a temperature in the range of 200.0° C. to 400.0° C., (ii) exposing the utility fluid to a temperature ≥400.0° C. and then combining the tar stream with the heated utility fluid, and/or (iii) exposing the hydrogen stream to a temperature ≥400.0° C. and then combining the tar stream with the heated hydrogen stream; and (g) hydroprocessing in a hydroprocessing zone at least a portion of the heated tar stream in the presence of (i) the hydrogen stream and/or heated hydrogen stream and (ii) the utility fluid and/or the heated utility fluid under catalytic hydroprocessing conditions at a utility fluid:tar stream weight ratio in the range of 0.05 to 3.0 to produce a hydroprocessed product, wherein the utility fluid comprises the hydroprocessed product in an amount ≥10.0 wt. % based on the weight of the utility fluid;

wherein the hydroprocessing zone comprises at least two catalyst beds, wherein external heat is supplied to at least the first catalyst bed; and wherein the first catalyst bed to which external heat is supplied comprises a multiplicity of tubes containing at least one hydroprocessing catalyst and the at least a portion of the tar stream, the hydrogen stream and the utility fluid are conducted through the multiplicity of tubes under catalytic hydroprocessing conditions, and the external heat is supplied to the outer surfaces of the multiplicity of tubes.

2. The process of claim 1, wherein the hydroprocessed product is continuously produced for at least $6.0\times10^5$ seconds.

3. The process of claim 1, wherein the hydroprocessed product is continuously produced for at least $2.6\times10^6$ seconds.

4. The process of claim 1, wherein the hydroprocessed product is continuously produced for at least $3.2\times10^7$ seconds.

5. The process of claim 1, wherein the first mixture's hydrocarbon comprises one or more of naphtha, gas oil, vacuum gas oil, waxy residues, atmospheric residues, residue admixtures, or crude oil.

6. The process of claim 1, wherein the second mixture's tar comprises (i) ≥10.0 wt. % of molecules having an atmospheric boiling point ≥565° C. that are not asphaltenes, and (ii) ≤1000.0 ppmw metals, the weight percents being based on the weight of the second mixture's tar.

7. The process of claim 1, wherein the hydroprocessing is conducted at a temperature in the range of 200.0° C. to 450.0° C. in the presence of at least one hydroprocessing catalyst.

8. The process of claim 1, wherein the tar is heated in step (f) (i) to a temperature in the range of 200.0° C. to 300.0° C.

9. The process of claim 1, wherein step (f) (i) includes (A) conducting the tar stream through at least one heater, wherein the tar stream abstracts heat, (B) conducting the tar stream through first channels of at least one heat exchanger and conducting at least a portion of the hydroprocessed product through second channels of the heat exchanger to abstract heat from the hydroprocessed product to the tar stream, or (C) exothermically reacting at least a portion of the tar stream.

10. The process of claim 1, wherein (i) the hydroprocessed product comprises ≥10.0 wt. % of a light fuel oil component and ≥10.0 wt. % of a heavy fuel oil component based on the weight of the hydroprocessed product, (ii) the utility fluid comprises the light fuel oil component in an amount ≥90.0 wt. % based on the amount of the utility fluid, and (iii) the light fuel oil component has an ASTM D86 10% distillation point ≥60.0° C. and a 90% distillation point ≤350.0° C.

11. The process of claim 1, wherein step (f) (i) includes conducting the tar stream together with the utility fluid through at least one heater, wherein the tar stream and the utility fluid absorbs heat from the heater.

12. The process of claim 1, wherein step (f) (i) includes conducting the hydrogen stream, the tar stream, together with the utility fluid through at least one heater, wherein the tar stream, the utility fluid and the hydrogen stream abstract heat from the heater.

13. The process of claim 1, wherein step (f) includes heating the utility fluid to a temperature ≥425.0° C. and combining the tar stream with the heated utility fluid.

14. A hydrocarbon conversion process, comprising:

(a) providing a first mixture comprising ≥50.0 wt. % hydrocarbon based on the weight of the first mixture;

(b) pyrolysing the first mixture in the presence of steam to produce a second mixture comprising ≥1.0 wt. % of $C_2$ unsaturates and ≥1.0 wt. % tar, the weight percents being based on the weight of the second mixture;

(c) separating a tar stream from the second mixture wherein the tar stream contains ≥90 wt. % of the second mixture's molecules having an atmospheric boiling point of ≥290° C.;

(d) providing a utility fluid, the utility fluid comprising ≥1.0 wt. % aromatics based on the weight of the utility fluid;

(e) providing a hydrogen stream comprising molecular hydrogen;

(f) heating the tar stream to a temperature $T_1$ in the range of 200.0° C. to 400.0° C. by one or more of (i) conducting the tar stream through at least one heater, (ii) conducting the tar stream through first channels of at least one heat exchanger and conducting a heat transfer fluid through second channels of the heat exchanger to abstract heat from the heat transfer fluid to the tar stream, or (iii) heating the utility fluid to a temperature ≥425.0° C. and combining the tar stream with the heated utility fluid;

(g) hydroprocessing at least a portion of the tar stream in a hydroprocessing zone in the presence of the hydrogen stream and the utility fluid under catalytic hydroprocessing conditions, the hydroprocessing conditions including a temperature in the range of from 300° C. to 500° C., a pressure in the range of 15 bar (absolute) to 135 bar (absolute), and a utility fluid:tar stream weight ratio in the range of 0.05 to 3.0, wherein (i) the utility fluid comprises the hydroprocessed product in an amount ≥50.0 wt. % based on the weight of the utility fluid and (ii) the heat transfer fluid comprises the hydroprocessed product in an amount ≥50.0 wt. % based on the weight of the heat transfer fluid;

wherein the hydroprocessing zone comprises at least two catalyst beds, wherein external heat is supplied to at least the first catalyst bed; and wherein the first catalyst bed to which external heat is supplied comprises a multiplicity of tubes containing at least one hydroprocessing catalyst and the at least a portion of the tar stream, the hydrogen stream and the utility fluid are conducted through the multiplicity of tubes under catalytic hydroprocessing conditions, and the external heat is supplied to the outer surfaces of the multiplicity of tubes.

15. The process of claim 14, wherein the pressure drop across the hydroprocessing zone is less than 3.0 times the initial pressure drop across the hydroprocessing zone.

16. The process of claim 14, wherein the hydroprocessing's hydrogen consumption per unit volume of the tar stream does not exceed 267 S $m^3/m^3$.

17. The process of claim 14, wherein the hydroprocessing zone is divided into at least a first and second hydroprocessing zone and wherein the first hydroprocessing zone operates at a temperature of at least 100° C. less than the second hydroprocessing zone.

18. The process of claim 14, wherein the hydroprocessing zone comprises at least one bed of high-activity hydrotreating catalyst.

19. The process of claim 18, wherein the catalyst includes at least one metal from any of Groups 5 to 10 of the Periodic Table of the Elements.

* * * * *